US005124631A

United States Patent [19]

Terashima

[11] Patent Number: 5,124,631

[45] Date of Patent: Jun. 23, 1992

[54] VOLTAGE REGULATOR

[75] Inventor: Yoshiyuki Terashima, Suwa, Japan

[73] Assignee: Seiko Epson Corporation, Japan

[21] Appl. No.: 513,682

[22] Filed: Apr. 24, 1990

[30] Foreign Application Priority Data

Apr. 26, 1989 [JP] Japan ..... 1-106426
Feb. 22, 1990 [JP] Japan ..... 2-41951

[51] Int. Cl.[5] ..... G05F 3/24

[52] U.S. Cl. ..... 323/313; 323/317; 323/280; 307/296.8; 365/189.09

[58] Field of Search ..... 323/313, 314, 315, 316, 323/317, 272, 280; 307/296.5, 296.8; 331/188; 365/189.09

[56] References Cited

U.S. PATENT DOCUMENTS 4,163,161 7/1979 Walker ..... 307/296.8
4,186,436 1/1980 Ishiwatari ..... 363/60
4,377,781 3/1983 Tatsushi et al. ..... 323/313
4,506,350 3/1985 Asano et al. ..... 365/191
4,587,477 5/1986 Hornak et al. ..... 323/317
4,752,699 6/1988 Cranford, Jr. et al. ..... 307/296.8
4,853,610 8/1989 Schode, Jr. ..... 323/316
4,893,275 1/1990 Tanaka et al. ..... 323/313
4,939,633 7/1990 Rhodes et al. ..... 323/285
4,954,769 9/1990 Kalthoff ..... 323/313

*Primary Examiner*—Steven L. Stephan
*Assistant Examiner*—Emanuel Todd Voeltz
*Attorney, Agent, or Firm*—W. Douglas Carothers, Jr.

[57] ABSTRACT

A voltage regulator forms a constant voltage based on the sum voltage of the threshold voltages of multiple transistors comprising multiple first transistors with mutually different threshold voltages, a first switch to select a first transistor output from the multiple first transistors, multiple second transistors with mutually different threshold voltages and a second switch to select a second transistor from the multiple second transistors, and a summing circuit connected to the multiple first and second transistors for providing a sum voltage from the threshold voltages of the selected first and second transistors. Alternatively, the voltage output of a single transistor in lieu of one of said multiple transistor groups and may be combined with the output voltage of a selected transistor from the other multiple transistor group for input to the summing circuit.

14 Claims, 5 Drawing Sheets

VOLTAGE REGULATOR

BACKGROUND OF THE INVENTION

This invention relates generally to voltage regulators and more particularly to voltage regulators for integrated circuits requiring low voltage and low power consumption.

FIG. 2 shows an example of a prior art voltage regulator for a clock IC requiring low voltage and low current consumption. The reference voltage is formed by a p-channel insulated gate field-effect transistor (IGFET) 206 whose gate and drain are connected and a constant current source 201. By designing the $\beta$ of transistor 206 relatively large, the voltage $V_{DD}-V_1$, expressed as $V_1$, becomes nearly equal to the threshold voltage $V_{T206}+\alpha$ of the transistor 206. The output of operational amplifier (OP-AMP) 202 is impressed on the gate of transistor 204. Where the threshold voltage of the n-channel MOS transistor 216 whose gate and drain are connected is $V_{T216}$, the voltage $V_{T216}+\alpha$ is output as the potential difference between $V_1$ and $V_2$. Source 203 is a constant current source for transistor 216.

Considering the overall operation of the circuit of FIG. 2, the voltage $V_{DD}-(V_{T206}+V_{T216}+\alpha'')$ is output to the terminal, $V_{OUT}$, and when $V_{DD}$ is considered as the reference voltage, this output a constant voltage, i.e., the sum of voltages of the threshold voltage of p-channel transistor 206 and the threshold voltage of n-channel transistor 216 becomes the output, $V_{OUT}$.

FIG. 3 shows a graph in which the voltage sums of $V_{T206}+V_{T216}$ and the constant voltage output, $V_{OUT}$, of the prior art circuit of FIG. 2 are plotted respectively on the horizontal axis and the vertical axis of the graph. In the figure, (a) shows the case in which the threshold voltage ($V_{TP}$ below) of the p-channel transistor and the threshold voltage ($V_{TN}$ below) of the n-channel transistor are both high, (b) shows the case in which $V_{TP}$ is high and $V_{TN}$ is low, (c) shows the case in which $V_{TP}$ is low and $V_{TN}$ is high, and (d) shows the case in which both $V_{TP}$ and $V_{TN}$ are low. These values are idealistically considered to be a straight line condition, as represented by the doted line in FIG. 3. However, actual measured data shows that the threshold voltage ($V_{TH}$) of OP-AMP 202 also varies at the same time while the conductance coefficient $\beta$ of transistor 206 also fluctuates so that they vary from the ideal straight line condition as illustrated in FIG. 3.

When a CMOS oscillation circuit is connected as the load to the output of the circuit of FIG. 2, the oscillation start/stop voltage is proportional to $SV_{TH}$, assuming $\Sigma V_{TP}+V_{TN}=\Sigma V_{TH}$. Considering that the current consumption is inversely proportional to $\Sigma V_{TH}$, on an ideal straight line condition, when $V_{TH}$ rises, for example, the oscillation start/stop voltage rises and the current consumption drops. However, since the power source of the oscillation circuit is being supplied from a voltage regulator, the power source output also rises, and when considered overall, the oscillation start/stop voltage does not rise. Also, if $V_{TH}$ drops, the oscillation start/stop voltage should drop and the current consumption will rise. However, since the constant voltage also drops, overall, the two values hardly change at all.

That is, a stable oscillation circuit can be supplied with respect to $V_{TH}$, but actually the constant voltage output is shifted from the ideal straight line condition, and the nonlinear portion results in a drop in yield.

It is an object of the present invention to provide a constant voltage source proximating an ideal straight line characteristic.

SUMMARY OF THE INVENTION

According to this invention, to absorb the fluctuation in the constant voltage, multiple (m) transistors with mutually different threshold voltages are employed in place of transistor 206 and multiple (n) transistors with mutually different threshold voltages are employed in place of transistor 216. By combining the two, $m\times n$ constant voltage outputs are obtained from which near ideal straight line conditions can be derived. FUSE, FAMOS or other types of non-volatile memories may be employed to perform the selection and the optimum state is selected through inspection of each integrated circuit.

The voltage regulator of this invention forms a constant voltage based on the sum voltage of the threshold voltages of multiple transistors comprising multiple first transistors with mutually different threshold voltages, first switch means to select a first transistor output from the multiple first transistors, multiple second transistors with mutually different threshold voltages and second switch means to select a second transistor from the multiple second transistors, and summing means connected to the multiple first and second transistors for providing a sum voltage from the threshold voltages of the selected first and second transistors. Alternatively, the voltage output of a single transistor in lieu of one of said multiple transistor groups and may be combined with the output voltage of a selected transistor from the other multiple transistor group for input to the summing means.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
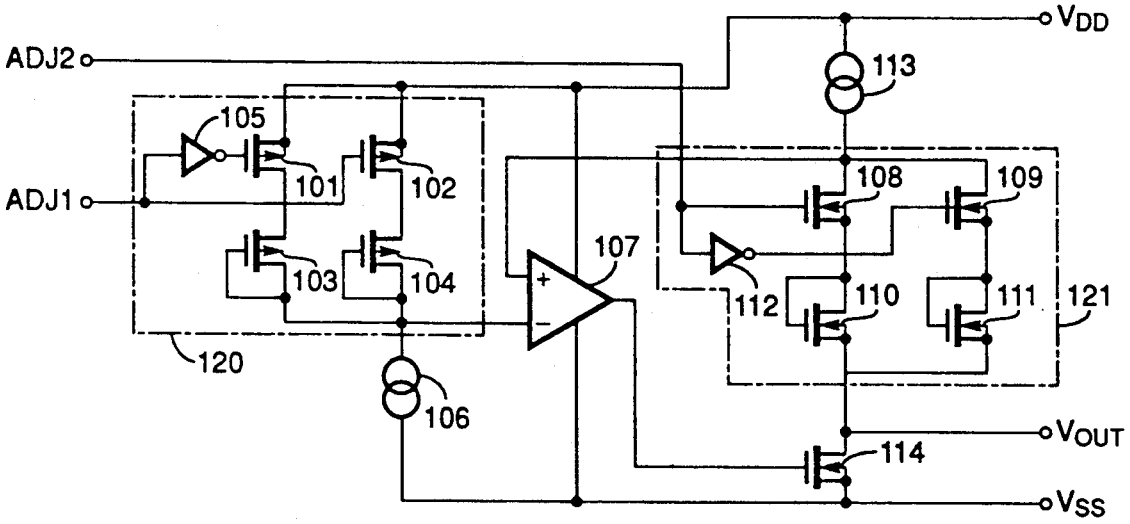
FIG. 1 is a schematic diagram of a voltage regulator concerning one embodiment of this invention.
Figure 2:
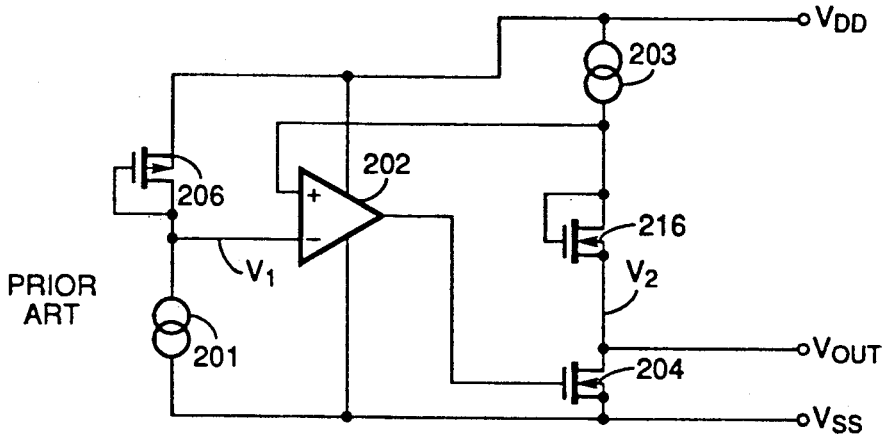
FIG. 2 is a schematic diagram of a circuit of the prior art.
Figure 3:
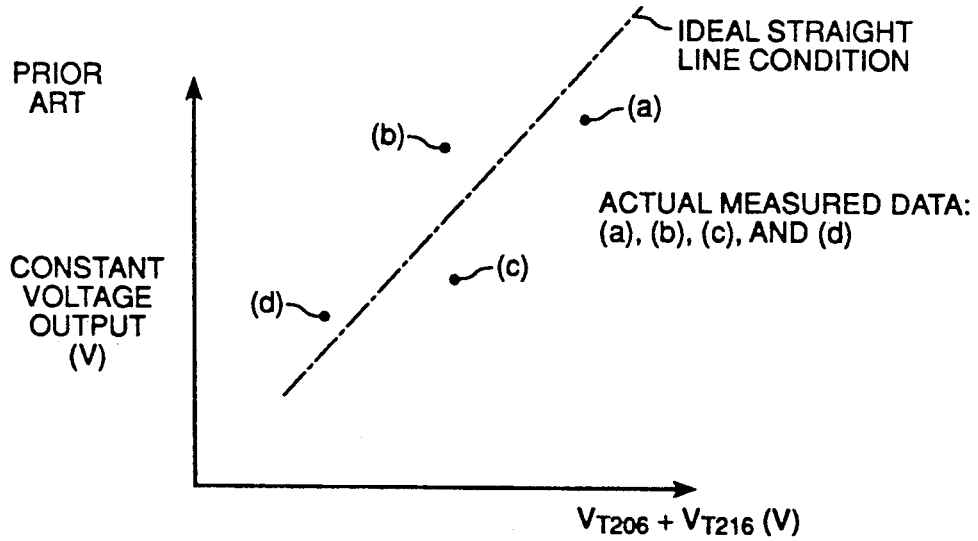
FIG. 3 is a graph showing the relationship between the constant voltage output and the threshold voltages relative to the circuit of FIG. 2.

Reference is now made to FIG. 1 which illustrates a first embodiment of this present invention. The voltage regulator shown in FIG. 1 is utilized as the power source for oscillation circuits composed, for example, of CMOS. In FIG. 1, multiple transistor block 120 comprises a group of p-channel transistors 101–104 and multiple transistor block 121 comprises a group of n-channel transistors 108–111. Constant current source 106 supplies current to p-channel transistors 103 and 104 in block 120. The p-channel transistors 101 and 102 are switching transistors. Transistors 103 and 104 have their gates connected to their drains and their sources respectively connected to drains of switching transistors 101 and 102. The sources of transistors 101 and 102 are connected in common to reference, $V_{DD}$. The p-channel transistors 103 and 104 have mutually different $V_{TH}$, where the $V_{TH}$ of transistor 103 is $P_1$ and the $V_{TH}$ of transistor 104 is $P_2$. Further, in block 121, n-channel transistors 108 and 109 are switching transistors and n-channel transistors 110 and 111 have mutually different $V_{TH}$, where the $V_{TH}$ of 110 is $N_1$ and the $V_{TH}$ of 111 is $N_2$. Constant current source 113 supplies current to block 121. $ADJ_1$ and $ADJ_2$ are binary control inputs respectively connected to the gates of switching transistors 101, 102 and 108, 109. Inverters 105 and 112 are respectively connected between $ADJ_1$ and $ADJ_2$ and the gates of transistors 101 and 109 of respective blocks 120 and 121. The outputs of blocks 120 and 121 are respectively connected to the − input terminal and the + input terminal of OP-AMP 107 and the output of OP-AMP 107 is supplied to the gate of n-channel transistor 114 which is connected between $V_{SS}$ and $V_{OUT}$.

Alternatively, to provide the constant voltage source of this invention, one of the multiple transistor blocks 120 or 121 could be replaced by the output of a single transistor so that the voltages to be summed would be from a selected transistor from a block 120 or 121 and such another single transistor.

As a first example, consideration will be given for the condition where $(ADJ_1, ADJ_2)=(1, 1)$. In this example, "1" represents the $V_{DD}$ level and "0" represents the $V_{SS}$ level. The transistors 101 and 102 are OFF. Therefore, the current flows along the circuit route 101→103→106, and 102 and 104 need not be considered. The gate and drain in transistor 103 are connected so that it operates in the saturation range and functions as a diode. If $\beta$ is large, a constant voltage $(P_1+\alpha)$ is generated with $V_{DD}$ as the reference voltage upon application of a constant current flow.

Further, since $ADJ_2$ is at the $V_{DD}$ level, transistor 108 becomes in its ON state and transistor 109 becomes in its OFF state. Therefore, transistors 109 and 111 need not be considered. As a result, a $(N_1+\alpha')$ voltage is generated between OP-AMP + input terminal and the output, $V_{OUT}$. Since OP-AMP 107 operates to match the voltages of the + and − input terminals, by using $V_{DD}$ as the reference voltage, inputting a $(P_1+\alpha)$ voltage to the − input terminal will result in a $(P_1+\alpha+N_1\alpha')$ voltage being fed back to the − input terminal. This feedback voltage is expressed as $P_1+N_1+\alpha''$, and nearly the total voltage sum of the p-channel transistor and the n-channel transistor will be output at $V_{OUT}$. The value of $\alpha''$ is small compared to $P_1$ or $N_1$, so if it is ignored, the voltages in Table 1 below are outputs based on the $ADJ_1$ and $ADJ_2$ levels.

TABLE 1

| $ADJ_1$ | $ADJ_2$ | $V_{OUT}$ ($V_{DD}$ reference) |
|---|---|---|
| 0 | 0 | $P_1 + N_1$ |
| 0 | 1 | $P_1 + N_2$ |
| 1 | 0 | $P_2 + N_1$ |
| 1 | 1 | $P_2 + N_2$ |

In this example, two transistors are employed per bit for each of the p-channel and n-channel transistors for a total of $2\times2=4$ outputs. However, m transistors for block 120 and n transistors for block 121 in FIG. 1 may be employed as necessary to obtain $m\times n$ outputs. By connecting in series transistors, corresponding to transistors 103 and 104 of block 120, of the same conductance type and whose gate and drain are connected, a higher output voltage can be obtained. Using this same configuration for transistors 110 and 111 in block 121 will also yield a higher output voltage. Further, outputs according to Table 1 can obtained even if different conductance type transistors are used in blocks 120 and 121. Also, in FIG. 1, the transistors are arranged in the order 101 to 103 from $V_{DD}$, but the order from $V_{DD}$ can also be 103 to 110.

Figure 4:
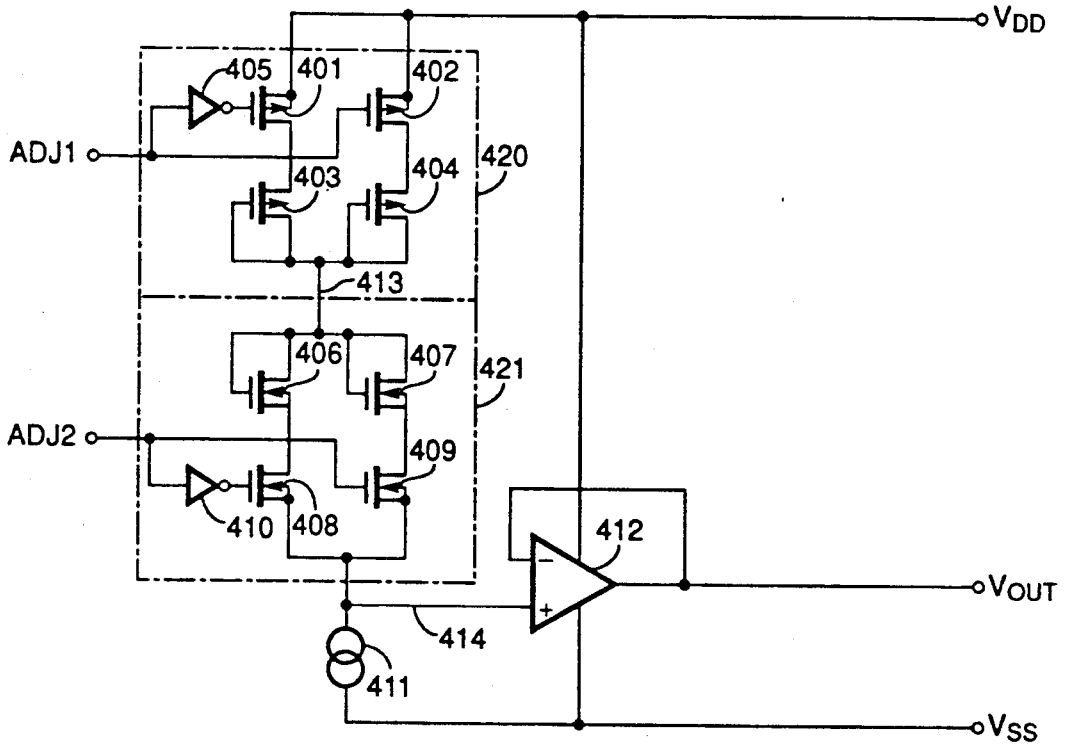
FIG. 4 is a schematic diagram of a voltage regulator comprising another embodiment of this invention.

FIG. 4 discloses another embodiment of a voltage regulator of this invention. Here, multiple transistor block 420 corresponds to multiple transistor block 120 in FIG. 1, and multiple transistor block 421 corresponds to multiple transistor block 121. In FIG. 4, 401 to 404 are p-channel transistors, 406 to 409 are n-channel transistors, 405 and 410 are inverters, and 411 is constant current source. This circuit also generates a voltage using $V_{DD}$ as a reference. As in the above example of FIG. 1, the voltage $(P_1+\alpha)$ is generated at node 413 and the voltage $(P_1+\alpha+N_1+\alpha')$ is generated at 414. This alone results in a high impedance output so that the output voltage, $V_{OUT}$, is provided via buffer 412, which is an OP-AMP. The $ADJ_1$ and $ADJ_2$ combinations are the same as in Table 1 above, and nearly the same outputs are obtained. In this example, both p-channel transistors and n-channel transistors are employed, but this configuration permits multiple transistors in only the p-channel transistor block 420, multiple transistors in only the n-channel block 421, or a combination of the two.

Figure 5:
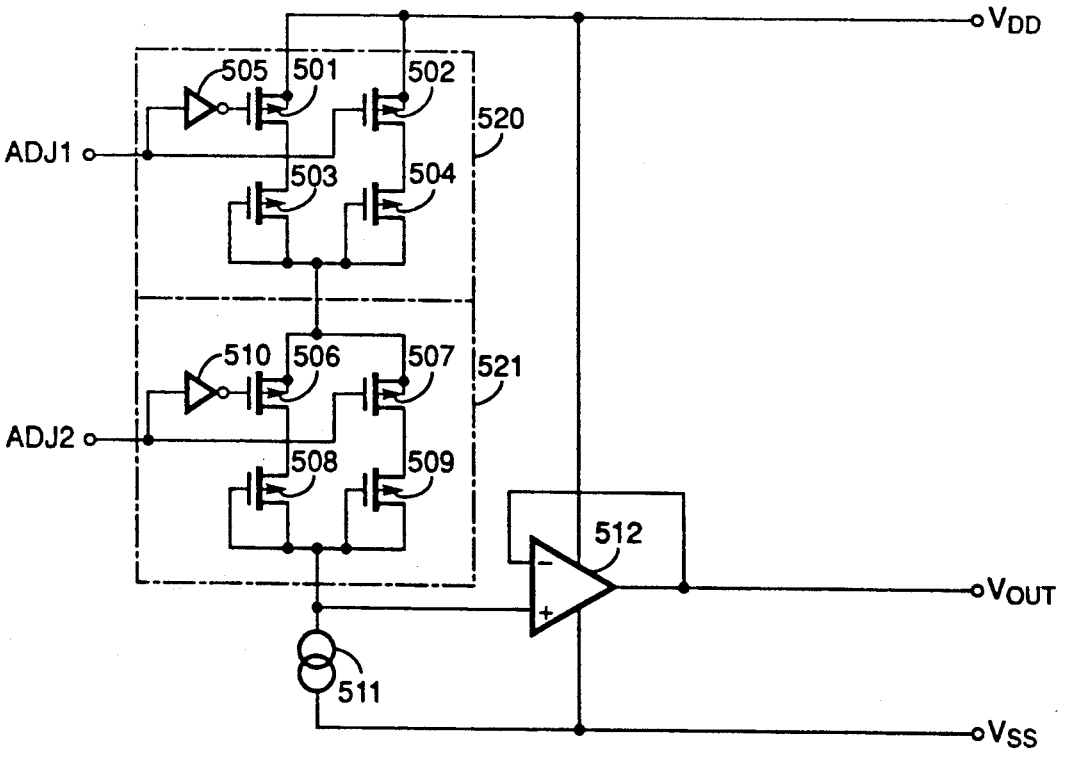
FIG. 5 is a schematic diagram of a voltage regulator of still another embodiment of this invention.

FIG. 5 shows another embodiment of a constant voltage source which employes the sum of the $V_{TH}$ of the p-channel transistors. In FIG. 5, 501 to 504 and 506 to 509 are p-channel transistors, 505 and 510 are inverters, and 512 is a buffer. In FIG. 5, both blocks 520 and 521 are p-channel transistor blocks. This voltage regulator is not employed as the power source for a CMOS type oscillation circuit, but rather it is employed as the power source for an oscillation circuit composed of only n-channel transistors.

Figure 6:
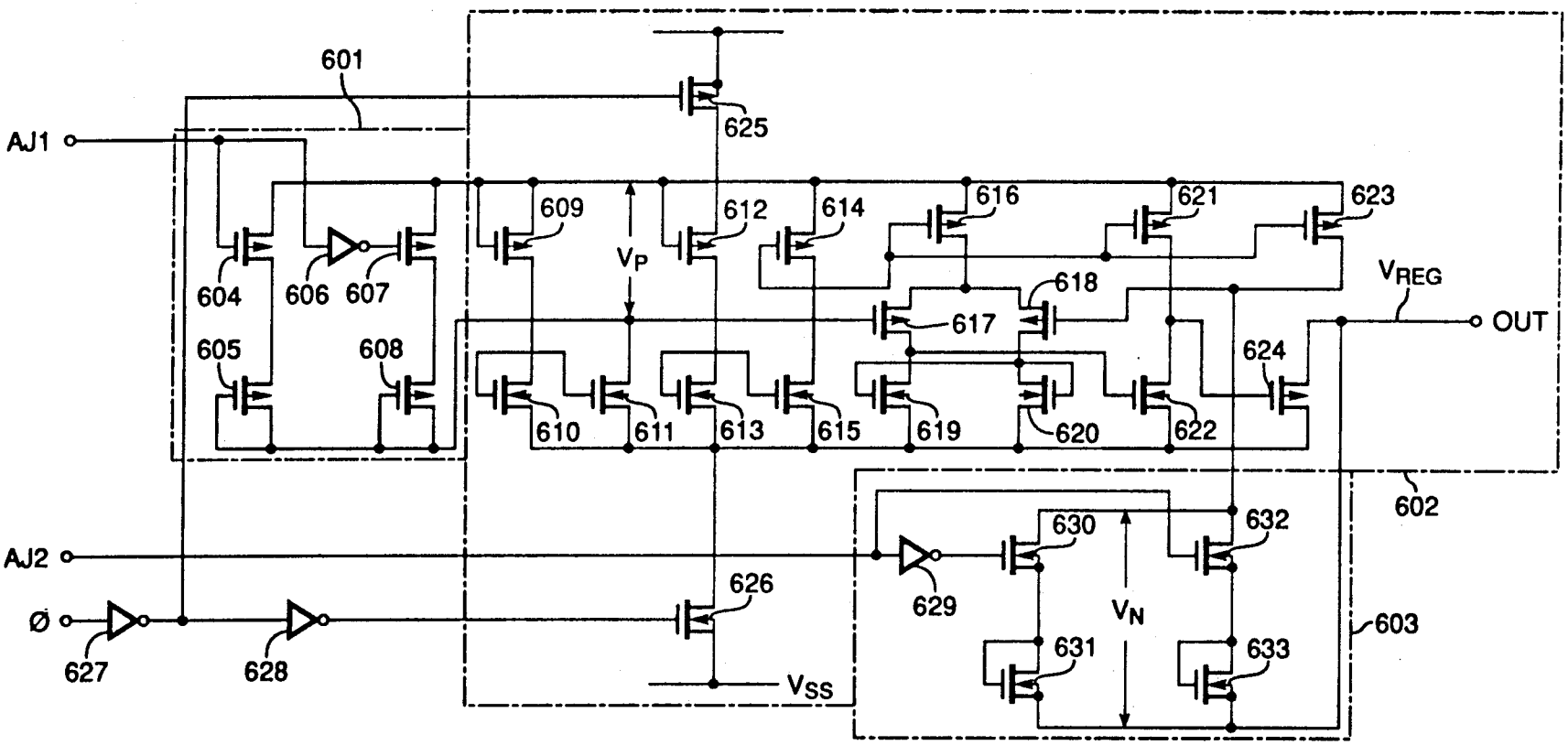
FIG. 6 is a schematic diagram of a voltage regulator of a further embodiment of this invention.

FIG. 6 shows a further embodiment of a constant voltage source comprising this invention. In FIG. 6, transistors 604, 605, 607 to 609, 612, 614, 616 to 618, 621 and 623 to 625 are p-channel transistors. Transistors 610, 611, 613, 615, 619, 620, 622 626 and 630 to 633 are n-channel transistors and 627 to 629 are inverters. Circuit block 602 and transistors 612 to 622 correspond to OP-AMP 107 in FIG. 1. Further, transistors 609 to 611 correspond to constant current source 106 and transistor 623 corresponds to constant current source 113 and transistor 624 corresponds to output transistor 114. Also, circuit block 601 corresponds to circuit block 120 which switches the two threshold voltages of the p-channel transistors and circuit block 603 corresponds to circuit block 121 which switches the two threshold voltages of the n-channel transistors. The threshold voltages of the transistors 605 and 608 inside block 601 are different, and in this example, the threshold voltage of transistor 605 is 0.55 V and the threshold voltage of transistor 608 is 0.35 V. The threshold voltages of transistors 631 and 633 inside block 603 are different, where the threshold voltage of transistor 631 is 0.55 V and the threshold voltage of transistor 633 is 0.65 V.

Voltages such as those noted below are generated at the output, $V_{OUT}$, based on the control inputs to $ADJ_1$ and $ADJ_2$. The voltages in Table 2 are calculated using $V_{DD}=0$ V.

TABLE 2

| $ADJ_1$ | $ADJ_2$ | $V_{OUT}$ ($V_{DD}$ reference) |
|---|---|---|
| 0 | 0 | −(0.55 + 0.55) = −1.1 V |
| 0 | 1 | −(0.55 + 0.65) = −1.2 V |
| 1 | 0 | −(0.35 + 0.55) = −0.9 V |
| 1 | 1 | −(0.35 + 0.65) = −1.0 V |

The voltages are generated in 0.1-V steps from 0.9 to 1.2 V. The ideal combination can be selected in combination with a liquid crystal oscillator circuit.

In the above configuration, a total of two bits can be selected with the combination of 1 bit + 1 bit. However, depending on the system, any number of bits can be employed.

A detailed explanation of the FIG. 6 is as follows. In the example, the values for $AJ_1=0$ and $AJ_2=0$ are employed. In this case, transistor 604 is ON and transistor 607 is OFF. As a result, the potential difference between the drain and source of transistor 604 is nearly zero and transistor 605 is therefore selected. Further, transistor 630 becomes ON and transistor 632 becomes OFF, so the potential difference between the drain and source of transistor 630 is nearly zero and transistor 631 is therefore selected. In this case, the combination of transistors 609, 610, 611 in block 602 and transistor 605 in block 601 compose the circuit which generates the reference voltage input to the OP-AMP in block 603 and its output voltage, $V_P$, is expressed by the following equation:

$$V_P = \sqrt{\frac{\beta_{609}}{\beta_{605}} \cdot \frac{\beta_{611}}{\beta_{610}}} \times |V_{609}| + V_{605} \quad (1)$$

Since $\beta_{610} = \beta_{611}$ and $\beta_{609} >> \beta_{605}$, $$V_P = V_{605} + \alpha \quad (2)$$

$$\text{Where, } \alpha = \sqrt{\frac{\beta_{609}}{\beta_{605}}} |V_{109}|$$

That is, a voltage a little higher than the threshold voltage of transistor 605 is output for $V_P$.

In transistor 603, however, $AJ_2=0$, so transistor 630 becomes ON, transistor 632 becomes OFF and, therefore, transistor 631 is selected. Since transistor 603 operates in the saturation range, the voltage between the drain and source is nearly 0 V, and therefore the output voltage of this voltage regulator with $V_{DD}$ as a reference is expressed as follows:

$$V_{DD} - V_{REG} = \sqrt{\frac{\beta_{623}}{\beta_{631}} \cdot \frac{\beta_{612}}{\beta_{614}}} \times |V_{609}| + V_P + V_{631} \quad (3)$$

When equation (2) is substituted, $$V_{DD} - V_{REG} = \sqrt{\frac{\beta_{623}}{\beta_{631}} \cdot \frac{\beta_{612}}{\beta_{614}}} \times |V_{609}| + V_{605} + \alpha + V_{631} = V_{605} + V_{631} + \alpha'' \quad (4)$$

From an examination of equation (4), the output is nearly the same as the voltage resulting from addition of the voltage $\alpha''$ to the sum of the threshold voltages of transistor 605 and transistor 631.

The above is true for the preconditions of $AJ_1=0$ and $AJ_2=0$. However, when $AJ_1=1$ and $AJ_2=0$, then:

$$V_{DD} = V_{REG} = V_{608} + V_{631} + \alpha'' \quad (5)$$

If a'' is minimized, however, the output becomes 1.10 V in equation (4) and 0.90 V in equation (5) when $V_{605}=0.55$ V, $V_{608}=0.35$ V and $V_{631}=0.55$ V and this constant voltage output can be varied externally by means of a binary input and in FIG. 6 this controlled by control signal, $\phi$, to the gate of transistor 625 via inverter 627 and to the gate of transistor 626 via both inverters 627 and 628. When the control signal, $\phi$, is a binary "1", the operation is performed.

Figure 7A:
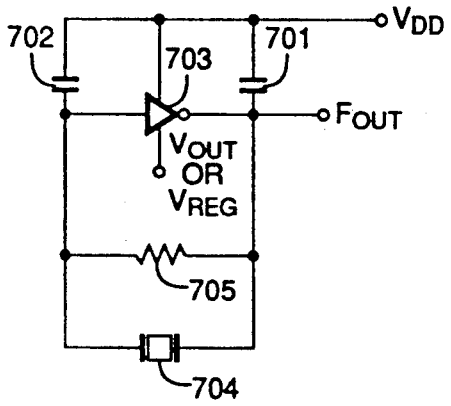
FIGS. 7A and 7B are schematic circuit diagrams of oscillation circuits employing a voltage regulator as a power source.
Figure 7B:
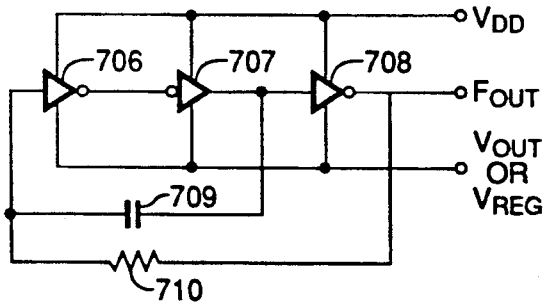

FIGS. 7A and 7B illustrate oscillating circuits which operate on the output voltages $V_{OUT}$ and $V_{REG}$ of the voltage regulators illustrated in FIG. 1 and in FIGS. 4–6. FIG. 7A is a liquid crystal oscillator, and FIG. 7B is a CR oscillator. Both oscillators have commonly used configurations. In these figures, 701, 702 and 709 are capacitors, 705 and 710 are feedback resistors, 703, 706, 707 and 708 are CMOS or single channel amplifying inverters and 704 is a crystal oscillator.

In summary, by employing the voltage regulators of this invention, output voltages can be obtained according to the number of bits. When fixed power sources of the prior art are employed as power sources for MOS oscillation circuits which require low power consumption, the start and stop oscillation and current consumption are unconditional set. Therefore, if an off-specification unit was found in testing, it was treated as defective, thus decreasing yield. By employing the voltage regulators of this invention, if a chip is about to terminate oscillation, for example, the output of the voltage regulator can be increased to allow a greater oscillation margin. On the other hand, if a chip with sufficient oscillation margin has too large of a current consumption, the output of the voltage regulator can be decreased thereby making it possible to offer optimal oscillation circuits. In other words, these voltage regulator configurations offers circuits with stable operation while also greatly improving the yield for a component which had inconsistent yield in the past. Even for units of the prior art which did not present a problem with yield, current consumption can be reduced to a minimum by the voltage regulator configurations of this invention thereby greatly contributing to low current consumption.

While the invention has been described in conjunction with several specific embodiments, it is evident to those skilled in the art that many further alternatives, modifications and variations will be apparent in light of the foregoing description. Thus, the invention described herein is intended to embrace at such alternatives, modifications, applications and variations as fall within the spirit and scope of the appended claims.

What is claimed is:

1. A voltage regulator forming a constant voltage based on the sum voltage of the threshold voltages of multiple transistor means, comprising:

a plurality of first transistors with mutually different threshold voltages, each first transistor having its gate electrode connected to its drain electrode and each having a respective threshold voltage, at least one second transistor having its gate electrode connected to its drain electrode and having a threshold voltage, first switch means for selecting one of said first transistors from said plurality of first transistors, and summing means coupled to said first selected transistor and said second transistor for providing said constant voltage including a sum voltage of the threshold voltages of both said selected first transistor and said second transistor.

2. The voltage regulator of claim 1 further comprising:

a plurality of second transistors with mutually different threshold voltages including said one second transistor, each second transistor having its gate electrode connected to its drain electrode and each having a respective threshold voltage, and second switch means for selecting one of said second transistors from said plurality of second transistors, said summing means coupled to said first and second selected transistors for providing said constant voltage including a sum voltage of the threshold voltages of both said selected first and second transistors.

3. The voltage regulator of claim 1 further comprising:

an operational amplifier having one of two inputs connected to receive the threshold voltage of said selected first transistor, an output transistor coupled to said second transistor in series to form a series circuit, the gate electrode of said output transistor coupled to the output of said operational amplifier, and one side of said series circuit coupled as feedback to other of said inputs of said operational amplifier.

4. The voltage regulator of claim 3 wherein said selected first transistor and said second transistor are of mutually differing conductivity types.

5. The voltage regulator of claim 2 wherein said selected first transistor and said selected second transistor are coupled in series to form a series circuit and said constant voltage including the sum voltage of the threshold voltages of said selected first and second transistors is generated at one end of said series circuit.

6. The voltage regulator of claim 5 wherein said selected first and second transistors are of mutually differing conductivity types.

7. The voltage regulator of claim 6 functioning as a power source for an oscillator circuit composed of CMOS transistors.

8. The voltage regulator of claim 5 wherein said selected first and second transistors are of the same conductivity type.

9. The voltage regulator of claim 8 wherein said voltage regulator is employed as a power source for an oscillation circuit composed of transistors of the same conductivity type as said selected first and second transistors.

10. The voltage regulator of claim 5 further comprising a buffer consisting of an operational amplifier, the output of said series circuit connected to one input of said buffer and the output from said buffer connected as feedback to the other input of said buffer.

11. The voltage regulator of claim 4 functioning as a power source for an oscillator circuit composed of CMOS transistors.

12. A voltage regulator which forms a constant voltage based on the sum voltage of the threshold voltages of transistors as a power source, comprising:

a plurality of first transistors with mutually different threshold voltages, each first transistor having its gate electrode connected to its drain electrode and each having a respective threshold voltage, at least one second transistor having its gate electrode connected to its drain electrode and having a threshold voltage, switching means for selecting one of said first transistors from said plurality of first transistors, and summing means coupled to said first selected transistor and said second transistor for providing said constant voltage including a sum voltage of the threshold voltages of both said selected first transistor and said second transistor.

13. The voltage regulator of claim 12 wherein said switching means includes first switching means and second switching means and said first switch means is connected in series with said first selected transistor and comprises a transistor that is of the same conductivity type as said first selected transistor and said second switch means is connected in series with said second transistor and comprises a transistor that is of the same conductivity type as said second transistor.

14. An oscillator having a voltage regulator and oscillator circuit means wherein said voltage regulator provides a constant voltage based on the sum voltage of the threshold voltages of a plurality of transistors comprising:

a plurality of first transistors with mutually different threshold voltages, each first transistor having its gate electrode connected to its drain electrode and each having a respective threshold voltage, at least one second transistor having its gate electrode connected to its drain electrode and having a threshold voltage, switching means for selecting one of said first transistors from said plurality of first transistors, summing means coupled to said first selected transistor and said second transistor for providing said constant voltage including a sum voltage of the threshold voltages of both said selected first transistor and said second transistor, and wherein said oscillation circuit means includes a capacitor and resistance means to supply said constant voltage containing the sum of the threshold voltages of both said selected first transistor and said second transistor.

* * * * *